United States Patent [19]

Hou

[11] Patent Number: 4,925,182

[45] Date of Patent: May 15, 1990

[54] CAROUSEL DEVICE

[76] Inventor: Jack Hou, P.O. Box 78-95, Taipei, Taiwan

[21] Appl. No.: 321,317

[22] Filed: Mar. 10, 1989

[51] Int. Cl.[5] ..... A63H 13/20

[52] U.S. Cl. ..... 272/31 R; 74/49; 74/50; 272/42

[58] Field of Search ..... 272/31 R, 31 A, 31 B, 272/31 P, 28 R, 28 S, 42, 44; 74/50, 49

[56] References Cited

U.S. PATENT DOCUMENTS

| | | | |
|---|---|---|---|
| 51,029 | 11/1865 | Ellinwood . | |
| 546,912 | 9/1895 | Boettcher . | |
| 1,271,892 | 7/1918 | Habeshan . | |
| 1,635,108 | 1/1926 | Bluthardt . | |
| 2,061,695 | 6/1936 | Dalton . | |
| 2,506,214 | 5/1950 | Harman . | |
| 2,569,922 | 10/1951 | Centofanti . | |
| 2,657,928 | 11/1953 | McDonald | 272/31 R |
| 2,715,530 | 8/1955 | Olsen . | |
| 2,846,223 | 8/1958 | Nelson . | |
| 3,191,930 | 6/1965 | Cottrell et al. . | |
| 3,279,793 | 10/1966 | Lakin . | |
| 3,398,588 | 8/1968 | Meier . | |
| 3,498,603 | 3/1970 | Lakin . | |
| 3,897,054 | 7/1975 | Riggs | 272/31 R |
| 4,052,898 | 10/1977 | Miller et al. . | |
| 4,272,996 | 6/1981 | Sauerwein . | |
| 4,289,040 | 9/1981 | Haluko, Jr. . | |
| 4,708,689 | 11/1987 | Hou . | |

*Primary Examiner*—Richard E. Chilcot, Jr.
*Attorney, Agent, or Firm*—Bacon & Thomas

[57] ABSTRACT

A display carousel simulates the movements of a full-size carousel by supporting the carousel figures on tappet rods that are caused to both reciprocate vertically and revolve around a central vertical column by a drive mechanism which rotates a crown gear that in turn also rotates drive gears connected to cam assemblies in engagement with cam followers carried by the tappet rods.

11 Claims, 4 Drawing Sheets

CAROUSEL DEVICE

BACKGROUND OF THE INVENTION

1. Field of the Invention

The present invention generally involves the field of technology pertaining to power-operated ornamental display devices. More specifically, the invention relates to an improved electrically driven ornamental display device in the form of a miniature carousel which is capable of imparting revolving and reciprocating movements to a plurality of ornamental figures in simulation of a full-size carousel.

2. Description of the Prior Art

Carousels have been popular for hundreds of years and have a wide appeal to people of all ages. Full-size carousels are generally only available in amusement parks where they can be seen and enjoyed. The appearance and operation of a carousel are very enjoyable to observe and there has existed a need to provide a miniature carousel which is capable of duplicating the revolving and reciprocating movements of a full-size carousel for display purposes In this way, those who enjoy amusement park carousels may also enjoy a miniature version of the apparatus a home.

SUMMARY OF THE INVENTION

It is an object of the invention to provide an improved display carousel.

It is another object of the invention to provide a miniature display carousel which is capable of duplicating the movements of a full-size carousel.

It is a further object of the invention to provide an improved power-operated drive mechanism for imparting revolving and reciprocating movements to the ornamental figures of a display carousel.

These and other objects of the invention are realized by providing a carousel device which includes a vertical column supported on a base containing an electric power source. A disc is rotatably mounted on the column and provided with a plurality of tappet rods spaced around its periphery for supporting a corresponding number of ornamental figures simulating traditional carousel figures, such as miniature horses or the like. An electric motor and speed reduction gear assembly is also mounted on the disc and driven by the power source for rotating a crown gear. A plurality of drive axles, one of which is directly driven by the speed reduction gear assembly, are provided with drive gears in meshed engagement with the crown gear. The drive axles are also provided with cam assemblies which engage cam followers carried by the tappet rods. A stepped conductor plate assembly supported on the disc supplies electric power to the motor through electric contacts in conductive engagement with the assembly plate. Operation of the electric motor causes the speed reduction gear assembly to rotate the crown gear, thereby rotating the disc and drive axles. The rotating motion of each drive axle is converted to a reciprocating movement of its corresponding tappet rod by the cam assembly and cam follower so that the ornamental figures supported on the tappet rods are caused to simultaneously reciprocate vertically and revolve around the vertical column.

Other objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

Figure 1:
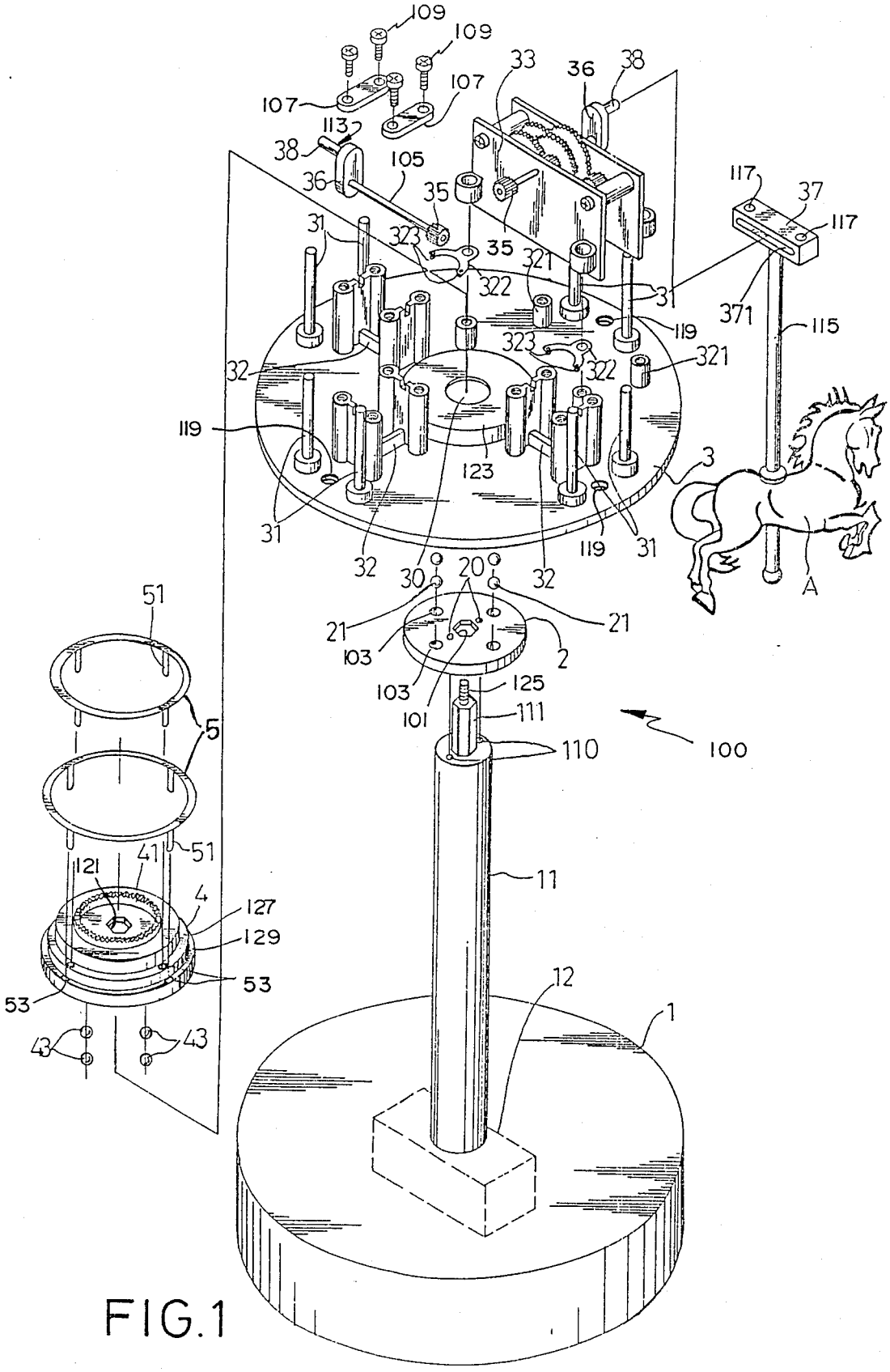
FIG. 1 is an exploded perspective view of a carousel device according to a preferred embodiment of the invention.

A carousel device 100 shall now be described with initial reference to FIG. 1 of the drawings As shown therein, device 100 includes a base 1 within which is contained an electric power source 12, such as a battery or means for connecting device 100 to a standard AC outlet. Source 12 is also preferably provided with an appropriate ON/OFF switch means. A hollow vertical column 11 is supported at its lower end on base 1 and extends upwardly therefrom. The upper end of column 1 is provided with a hexagonal-shaped stud 111 for receiving a bearing plate 2 having a correspondingly sized hexagonal aperture 101 therethrough. A rotatable disc 3 is disposed on bearing disc 1 and provided with a plurality of bearings 21 which are received within a plurality of corresponding races 103 provided in the upper surface of disc 2, and also preferably in the lower surface of disc 3.

The upper surface of disc 3 is provided with plural pairs of vertical guide rods 31 spaced around the periphery of disc 3. As seen in FIG. 1, there are provided four pairs of guide rods 31 offset by ninety degrees from each other around the periphery of disc 3. Adjacent three pairs of guide rods 31 are provided three corresponding axle supports 32, with each support 32 serving to support an axle 105 for rotation about a horizontal axis. It shall be noted that the pair of guide rods 31 not provided with an adjacent axle support 32 is instead provided with a plurality of guide stubs 321 for receiving and supporting a conventional drive mechanism 33 which comprises an electric motor, a belt wheel and a speed reducing gear assembly. It shall further be seen that mechanism 33 is also provided with an axle 105. For those pairs of guide rods 31 having an associated axle support 32, each corresponding axle 105 is secured thereto for horizontal rotation by a pair of apertured lock plates 107 and a plurality of mechanical fasteners 109.

Each axle 105 is provided with a cam assembly 113 at its outer end and a drive gear 35 at its inner end. Each cam assembly 113 includes a cam plate 36 and an offset cam element 38. A plurality of tappet rods 115, corresponding in number to the pairs of guide rods 31, are each provided with a cam follower 37 at its upper end and an ornamental figure A, such as a miniature horse or the like, mounted adjacent its lower end. Each cam follower 37 is provided with a slot 371 within which a corresponding cam element 38 is slidably engaged. Each cam follower 37 is also provided with a pair of spaced passageways 117 for slidably receiving a corresponding pair of guide rods 31 therethrough. With follower 37 mounted on guide rods 31, tappet rod 115 is slidably disposed through a corresponding aperture 119 provided in disc 3. Thus, in the assembled condition of device 100, the lower ends of tappet rods 115 extend downwardly below disc 3.

As also seen in FIG. 1, an annular stepped conductor plate 4 provided with a hexagonal-shaped aperture 121 therethrough is disposed on a raised central portion 123 of disc 3 provided with a central opening 30 so that stud 111 extends through aperture 101, opening 30 and aperture 121, and the entire assembly secured together by a nut in threaded engagement with a threaded shaft 125 provided on the upper end of stud 111. Central opening 30 is sized to permit free rotation of disc 3 relative to conductor plate 4, stud 111, and bearing disc 2. The bottom of conductor plate 4 is also provided with a plurality of bearings 43 in order to permit free rotation of disc 3 relative thereto. Conductor plate 4 includes an upper annular ledge 127 of smaller diameter and a lower annular ledge 129 of larger diameter. A pair of correspondingly sized annular conductive members 5 are disposed on ledges 127 and 29 by inserting a plurality of downwardly extending pins 51 into corresponding apertures 53 formed in ledges 127 and 129. A circular crown gear 41 is supported on the top of conductor plate 4 for engagement by drive gears 35. As also noted in FIG. 1, there are provided a pair of fork-shaped electrical brush contacts 322.

Figure 2:
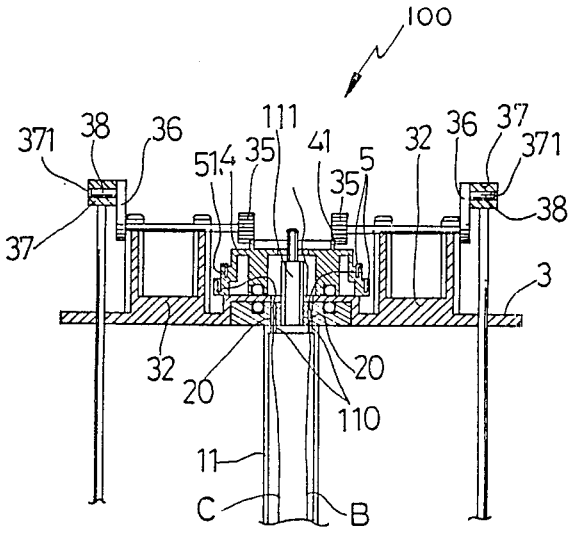
FIG. 2 is a partial vertical sectional view showing the disc supported for rotation on the vertical column and the manner in which rotary movement of the disc imparts reciprocating movement to the tappet rods.
Figure 3:
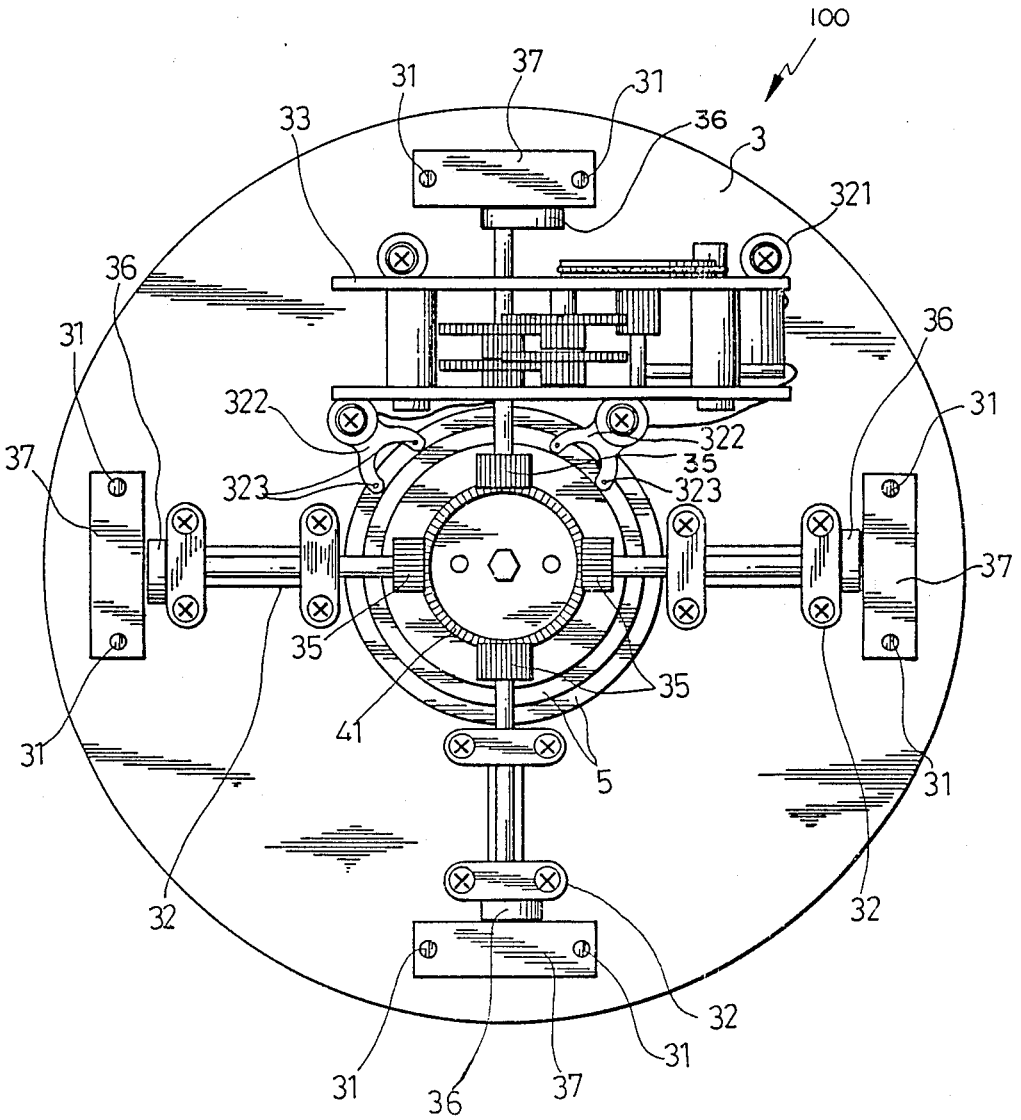
FIG. 3 is a top plan view of the device of FIG. 1, but depicted in assembled form.

With reference to FIGS. 2 and 3, device 100 is shown in its assembled form. A pair of negative and positive conductive wires B and C extend from power source 12 through vertical column 11 and are connected to contacts 322 which are, in turn, disposed in electrical connection with the electric motor of mechanism 33. As seen in FIG. 3, each contact 322 is of a substantially fork-shaped configuration and includes a pair of arms 323 in electrical contact with a corresponding conductive member 5. Wires B and C extend through holes 110 provided at the upper end of column 11 and through holes 20 provided in bearing disc 2, and finally through hole 30 of central portion 123 for respective linkage with an internal socket of conductor plate 4 and respective conducting members 5. Thus, legs 323 of each contact 322 are utilized for establishing electrical contact with members 5 during rotation thereof so that continuous conductivity of electricity from power supply 12 to the motor of mechanism 3 may be maintained during operation of device 100.

Figure 4:
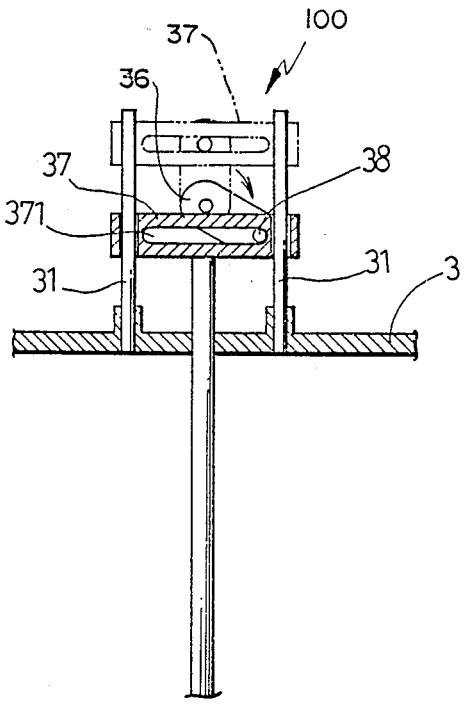
FIG. 4 is a partial vertical sectional view showing the manner in which the cam assembly and its associated cam follower reciprocates a corresponding tappet rod.

As also apparent from FIGS. 2 and 3, when motor of mechanism 33 is actuated, rotation of axle 105 associated with mechanism 33 is realized, with corresponding rotation of its associated drive gear 35. This, in turn, rotates crown gear 41 and causes corresponding rotation of remaining drive gears 35 and their associated axles 105, thus rotating disc 3 about the vertical axis of column 11. As more apparent in FIGS. 2 and 4, rotation of axles 105 also rotates cam plate 36 of each cam assembly 113, thereby causing the vertical reciprocation of each tappet rod 115 by virtue of the sliding engagement of cam element 38 within slot 371 of cam follower 37. This reciprocating movement is more clearly shown in FIG. 4.

From the foregoing, it is apparent that operation of device 100 in the manner described herein shall cause ornamental figures A supported on their respective tappet rods 115 to revolve around vertical column 11 while moving up and down. This dual movement exactly duplicates the same movements imparted to the figures of a full-size carousel apparatus.

It is to be understood that the form and configuration of the invention herein shown and described is to be taken as a preferred example or embodiment thereof, and that various changes in shape, material, size and arrangement of parts may be resorted to without departing from the spirit of the invention or scope of the subjoined claims.

I claim:

1. A carousel device comprising:

(a) a vertical column;

(b) a disc rotatably mounted on the column;

(c) a plurality of tappet rods spaced around the periphery of the disc for supporting a plurality of ornamental figures below the disc, each tappet rod including an upper end and a free lower end;

(d) first means for rotating the disc relative to the column;

(e) second means for raising and lowering each tappet rod during rotation of the disc, each second means including a cam assembly, a cam follower secured to the upper end of each tappet rod and driven by the cam assembly for imparting vertical reciprocating movement to each tappet rod, and guide means engaged by the cam follower for guiding the vertical movement of each tappet rod; and (f) whereby the ornamental figures are caused to move up and down while revolving around the column during operation of the device.

2. The carousel device of claim 1 further including:

(a) a base;

(b) the vertical column having an upper end and a lower end, the disc being rotatably mounted on the upper end of the column, and the lower end of the column being mounted on the base;

(c) each tappet rod includes an upper portion and a lower portion, the upper portions extending upwardly from the disc, and the lower portions extending downwardly from the disc for supporting the ornamental figures thereon; and (d) the free end of each tappet rod terminating short of the base.

3. The carousel device of claim 2 wherein:

(a) the first means for rotating the disc relative to the column includes a power drive means and a first gear means driven by the power drive means;

(b) the second means for raising and lowering the tappet rods further includes a plurality of drive axles, each axle having a cam assembly at one end, and a second gear means carried by the other end of each axle and driven by the first gear means; and (c) one drive axle being driven by the power drive means to rotate the disc.

4. The carousel device of claim 3 wherein:

(a) the power drive means includes an electric motor and a speed reduction gear assembly driven by the electric motor, with the one drive axle being driven directly by the speed reduction gear assembly;

(b) the first gear means includes a crown gear; and (c) the power drive source and crown gear being supported on the disc.

5. The carousel device of claim 4 further including:

(a) an electric power supply means disposed within the base;

(b) a circular conductor means mounted on the disc for receiving electric power from the power supply through the vertical column; and (c) electric contact means disposed in conductive engagement with the circular conductor means to supply electric power to the electric motor.

6. The carousel device of claim 5 further including:

(a) a hexagonal-shaped stud mounted on the vertical column;

(b) a bearing plate; and (c) the conductor means and bearing plate being non-rotatably mounted on the stud between the conductor means and bearing plate.

7. The carousel device of claim 5 wherein:

(a) the circular conductor means includes a plate having a stepped configuration defining a pair of annular ledges of different diameters; and (b) a pair of annular conductive members of corresponding diameters mounted on the annular ledges and disposed in conductive engagement with the electric contact means.

8. The carousel device of claim 1 wherein each cam follower includes a pair of spaced passageways, and the guide means includes a pair of spaced rods slidably received through each pair of spaced passageways.

9. A carousel device comprising:

(a) a base means;

(b) a vertical column extending upwardly from the base means;

(c) a support means rotatably mounted on the vertical column;

(d) at least one tappet rod including an upper end and a free lower end, the upper end of the tappet rod being carried by the support means; and (e) a cam assembly, a cam follower secured to the upper end of the tappet rod and driven by the cam assembly for imparting vertical reciprocating movement to the tappet rod, and guide means engaged by the cam follower for guiding the vertical movement of the tappet rod.

10. The carousel device of claim 9 wherein the cam follower includes a pair of spaced passageways and the guide means includes a pair of guide rods extending upwardly from the support means and slidably received through the spaced passageways.

11. The carousel device of claim 9 further including a first means for rotating the support means and a second means for driving the cam assembly to raise and lower the cam follower and tappet rod.

* * * * *